United States Patent [19]

Fecker

[11] Patent Number: 4,793,565

[45] Date of Patent: Dec. 27, 1988

[54] YARN STORAGE AND SUPPLY APPARATUS, PARTICULARLY FOR TEXTILE MACHINES

[75] Inventor: Josef Fecker, Bisingen-Steinhofen, Fed. Rep. of Germany

[73] Assignee: Memminger GmbH, Freudenstadt, Fed. Rep. of Germany

[21] Appl. No.: 113,279

[22] PCT Filed: Jan. 10, 1987

[86] PCT No.: PCT/DE87/00003

§ 371 Date: Aug. 3, 1987

§ 102(e) Date: Aug. 3, 1987

[87] PCT Pub. No.: WO87/04417

PCT Pub. Date: Jul. 30, 1987

[30] Foreign Application Priority Data

Jan. 21, 1986 [DE] Fed. Rep. of Germany ..... 3601586

[51] Int. Cl.[4] ..... B65H 51/22

[52] U.S. Cl. ..... 242/47.01

[58] Field of Search ..... 242/47.01, 47.04, 47.05, 242/47.06, 47.07, 47.08, 47.09, 47.1, 47.11, 47.12, 47.13; 139/452; 66/132 R, 132 T

[56] References Cited

U.S. PATENT DOCUMENTS

| | | | |
|---|---|---|---|
| 4,238,080 | 12/1980 | Van Mullekom | 242/47.01 X |
| 4,478,375 | 10/1984 | Sarfati et al. | 242/47.01 |
| 4,633,917 | 1/1987 | Riboli | 242/47.01 X |
| 4,669,677 | 6/1987 | Roser et al. | 242/47.01 |

FOREIGN PATENT DOCUMENTS

| | | |
|---|---|---|
| 192851 | 9/1986 | European Pat. Off. . |
| 3437252 | 1/1986 | Fed. Rep. of Germany . |
| 2087439 | 5/1982 | United Kingdom . |

*Primary Examiner*—Stanley N. Gilreath

*Attorney, Agent, or Firm*—Frishauf, Holtz, Goodman & Woodward

[57] ABSTRACT

A yarn storage and supply apparatus, in particular for textile machines, has a storage drum (4) in the manner of a cage with rods having a number of elongated yarn support elements located at identical radial intervals from the drum shaft (2) and distributed uniformly in the circumferential direction. Each of the yarn support elements, extending substantially in the drum shaft direction and secured to a drum body (13, 14, 15), is in the form of a narrow yoke (16), which on the yarn delivery side has a radially inwardly tapering region (17), acting as a run-on incline for the oncoming yarn (8), and adjoining it a substantially straight region (19), forming a yarn support region for a plurality of loops of yarn windings (20), the straight region being followed by a radially protruding circular, continuous yarn run-off rim (12). To prevent accumulations of fluff and so forth, the yarn run-off rim (12) is adjoined toward the run-on inclines of the yokes by a radially inwardly inclined circumferential face (24) on a rotationally symmetrical cover (23) coaxial with the drum shaft, which at least in the regions located between adjacent yokes (16) is continuous in the circumferential direction. The yokes (16) enter substantially smoothly into the cover (23). The circumferential face (24) is axially swept continuously by the outgoing yarn (8) on the yarn run-off side of the storage drum (4).

18 Claims, 3 Drawing Sheets

Fig. 3
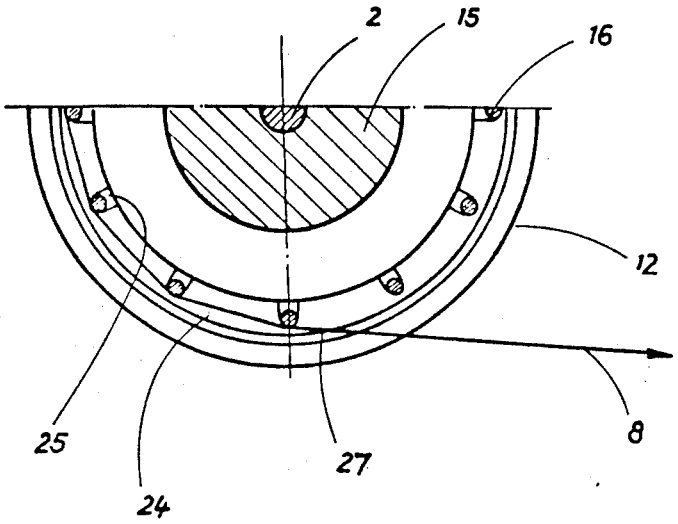
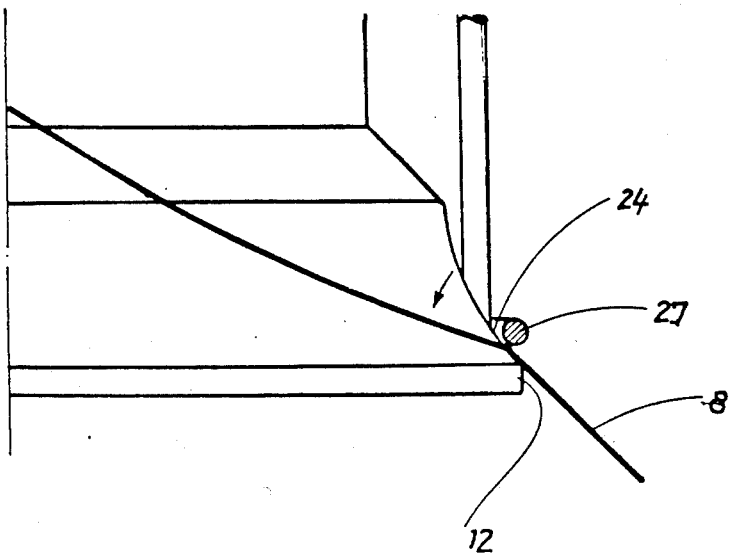
Fig. 4

YARN STORAGE AND SUPPLY APPARATUS, PARTICULARLY FOR TEXTILE MACHINES

BACKGROUND OF THE INVENTION

The invention relates to a yarn storage and supply apparatus, particularly for textile machines, having a storage drum in the manner of a cage with rods, which has a number of elongated yarn support elements, distributed uniformly at equal radial distances from the drum shaft and in the circumferential direction, which extend substantially in the direction of th drum shaft and are secured at both ends on a drum body or part connected with it and each element is embodied in the form of a narrow yoke.

It has been proposed to construct the yokes with regions tapering radially inward and acting as a run-on incline for the oncoming yarn and adjoining these regions further regions that at least in some segments are substantially straight and that form yarn support regions for a plurality of loops of one yarn winding; the substantially straight region is followed by a radially protruding circular continuous yarn run-off rim of the drum body or of some part connected with it. The tapering regions and the substantially straight regions of all the yokes are each located on common imaginary rotational bodies that are coaxial with the drum shaft. Yarn delivery and run-off elements are associated with the storage drum on the yarn delivery and run-off side. A drive device is provided for attaining a relative rotation between the storage drum and the yarn delivery and run-off elements.

Various embodiments of yarn supply devices having a storage drum, typically rotatably supported on a holder, embodied in the manner of a cage with rods and having yarn support elements formed by straight cylindrical wires or thin rods secured at both ends in flange-like parts of a drum body disposed on the storage drum shaft are known, for example from German patent Disclosure Documents DE-OS No. 31 04 516 and 0E-OS No. 27 23 210. The yarn winding forming on the rods comes to have a polygonal shape corresponding to the number of rods, and this is advantageous for good slip-free yarn carriage, while on the other hand the relatively narrow yarn support faces formed by the rods provide favorable conditions for the axial feed of the storage winding. In order to effect this axial feed of the storage winding, however, it must be provided with its own feed devices, which are relatively expensive and complicated.

A yarn supply apparatus (German Patent Disclosure Document DE-OS No. 34 37 252 to which U.S. Pat. No. 4,669,677, Roser, corresponds of this type, belonging to the prior art, that dispenses with such feed devices, has its storage drum formed as a cage with rods, with yarn support elements in the form of yokes comprising thin spring wire, which are secured at both ends on the drum body and each of which, on the yarn delivery side, has a radially inwardly tapering region, which acts as a run-on incline for the oncoming yarn and which is followed by a substantially straight region which forms the yarn support region for a plurality of loops of the yarn or storage windings. Because of the incline of the run-on region, the loops of the incoming yarn that form here are automatically fed axially toward the yarn support region, under the influence of the yarn tension, so that a continuous feeding of the storage windings is attained.

From the storage windings, the yarn travels via the radially protruding circular run-off rim, which is continuous in the circumferential direction, to the yarn run-out eyelet. The arrangement is such that the yarn run-off rim is located on the drum body in the manner of a circular disk, the plane of symmetry of which extends approximately at right angles to the yarn support region of the yarn support elements. This arrangement is also basically applicable to the storage drums of the yarn supply apparatuses referred to at the outset above.

When certain yarns are processed, in particular polyamide or polyester yarns of lesser quality, torn-off individual filaments or other fiber parts can come loose from the yarn and become wrapped around the rods or around generally free-standing yarn support elements, especially in the yarn run-off region. Adhering accumulations of such yarn or filament particles can also form in the yarn run-off region between the rods or yarn support elements, and these accumulations increase over a relatively long period of operation. The final result of both phenomena is to prevent the proper run-off of yarn from the storage drum, causing disruptions in yarn supply.

SUMMARY OF THE INVENTION

It is an object of the invention to improve a yarn supply apparatus of the type initially mentioned above such that even when such difficult-to-process yarns, such as polyamide or polyester yarns of lesser quality, are processed, the danger of undesirable accumulation of yarn particles that have torn off or become detached from the yarn, such as torn-off endless filaments, in the yarn run-off region of the storage drum is prevented.

Briefly, in the yarn storage and supply apparatus according to the invention the yarn run-off rim is followed in the direction toward the run-on inclines of the yokes by a radially inwardly inclined circumferential face of a rotationally symmetrical cover that is coaxial with the drum shaft, this cover being continuous in the circumferential direction, at least in the regions located between adjacent yokes, and into which cover the yokes enter substantially smoothly, and in that the circumferential face on the yarn run-off side of the storage drum is capable of being axially stripped continuously by the yarn running off the yarn support region and travelling to a yarn run-off element.

The circumferential face of the cover that is continuously stripped by the yarn as it runs off prevents lasting adhesion of an accumulation of fibers in the run-off region of the yarn. Since the yarn support elements enter smoothly into this circumferential face, idle spaces in the vicinity of the yarn support elements in which undesirable accumulations could grow cannot form either.

The circumferential face of the cover, beginning at a region of large diameter located in th vicinity of the run-off rim, extends with a region of lesser diameter radially inward at least as far as the middle of the substantially straight yoke parts. It is also suitable if the circumferential face connects smoothly at one end directly with the run-off rim.

The annularly continuous circumferential face of the cover may have the openings receiving the substantially straight yoke regions, so that the yokes are surrounded on all sides by the circumferential face.

The circumferential face of the cover may be substantially conical, but it has proved to be particularly advantageous if the circumferential face has a concave curvature.

The cover can suitably comprise a wear-resistant material, at least in the vicinity of the circumferential face, so tat even over long periods of operation any impairment of the surface by the yarn sweeping continuously over it is precluded.

Particularly simple structural conditions are attained if the drum body has two coaxial circular flanges, to which the yokes are secured at the ends and on one of which the run-off rim is formed. The yokes are thus advantageously located in a free-standing manner between the flange adjoining their run-on incline and the cover, at least in the vicinity of the circumferential face of the cover. This allows simple cleaning by means of compressed-air jet.

The yokes can also merge substantially at a tangent, in the vicinity of their run-on incline, with oblique portions of the surface of the adjoining flange, and the oblique surface portions can also be formed on rib-like regions, associated with the individual yokes, of the corresponding flange or of the drum body, the rib-like regions extending substantially radially. The drum body itself is advantageously made of plastic.

To facilitate axial feeding of the storage winding, the yokes can rest wit their substantially straight regions on an imaginary cone, the diameter of which decreases toward the run-off rim. It has proved advantageous in practice for the tapering in diameter of the straight regions of the yoke to amount to approximately 0.2 to 1 mm over its length.

The yokes are suitably bent from wear-resistant wire, but in principle it is also possible to make them from plastic advantageously coated in a wear-resistant manner, in which case they can then be formed onto the drum body directly or may be in the form of punched or injection molded parts and so forth.

In order to force the outgoing yarn to come into contact over the entire surface area with the yokes and the circumferential face cover, a yarn run-off ring can be attached loosely but in a captive manner to the yokes in the vicinity of the cover.

BRIEF DESCRIPTION OF THE DRAWINGS

Shown in the drawing is an exemplary embodiment of the subject of the invention. Shown are:

FIG. 3, a fragmentary plan view of the storage drum of FIG. 1, in a section taken along the line III—III of FIG. 2; and FIG. 4 a fragmentary side view of a detail of the storage drum of FIG. 2, in cutaway form.

DETAILED DESCRIPTION OF THE PREFERRED EMBODIMENT

Figure 1:
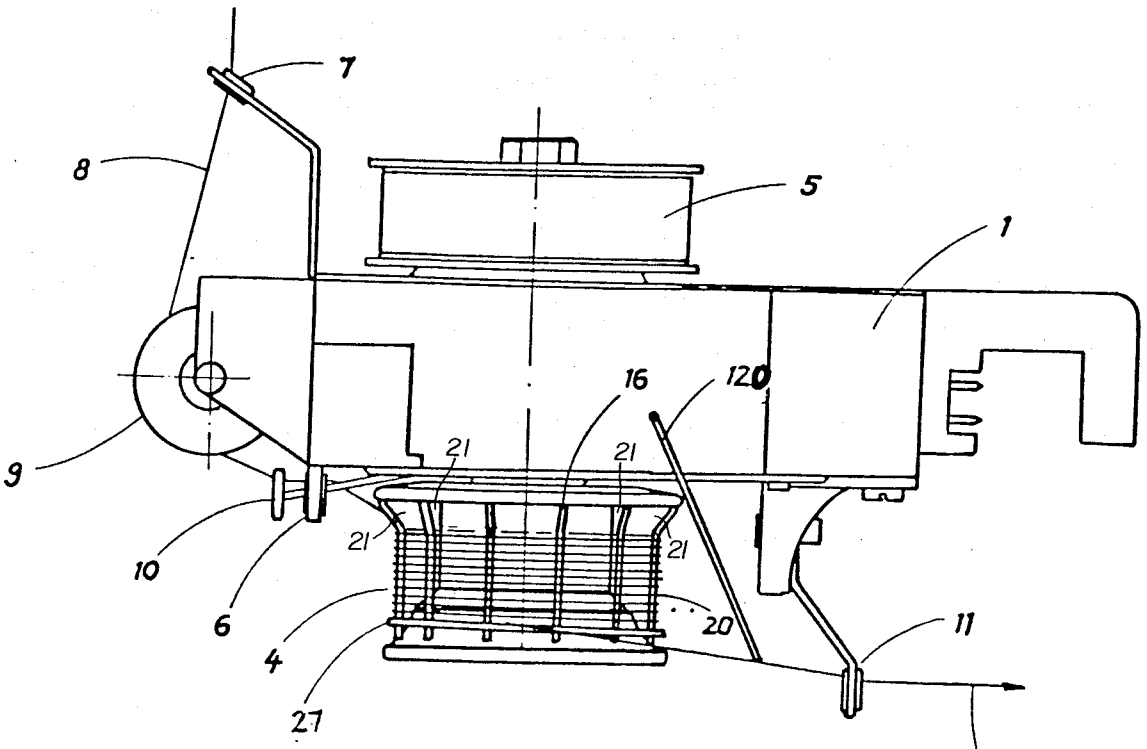
FIG. 1, a side view of a yarn storage and supply apparatus according to the invention.

The yarn storage and supply apparatus shown in FIG. 1 has a holder 1 arranged for being fastened on a frame ring of a circular knitting machine, and a storage drum 4 is rotatably supported on the holder, by means of a shaft 2 (see FIG. 3); as a drive device, a pulley 5, mounted on the shaft 2 such as to preclude relative rotation, is associated with the storage drum and can be set into rotation by a drive belt, not shown.

Located on the holder 1, as yarn delivery devices, are a yarn supply eyelet 6 and a yarn run-on eye 7, by means of which a yarn 8 arriving from a winding, not shown, is directed via a yarn brake 9, also provided on the holder 1, to the storage drum 4. A run-on sensor 10 scans the yarn travelling toward the storage drum 4 and in the event of yarn breakage effects a shutoff of the machine. The yarn 8 running off the storage drum 4 travels through a run-off eyelet 11 forming the yarn run-off device, which is secured to the holder 1 and is located laterally beside the storage drum 4 as well as below its run-off rim 12 by a predetermined distance, so that the yarn running off the storage drum 4 at a tangent is carried obliquely downward and radially outward; it is scanned by means of a run-off sensor 120.

Figure 2:
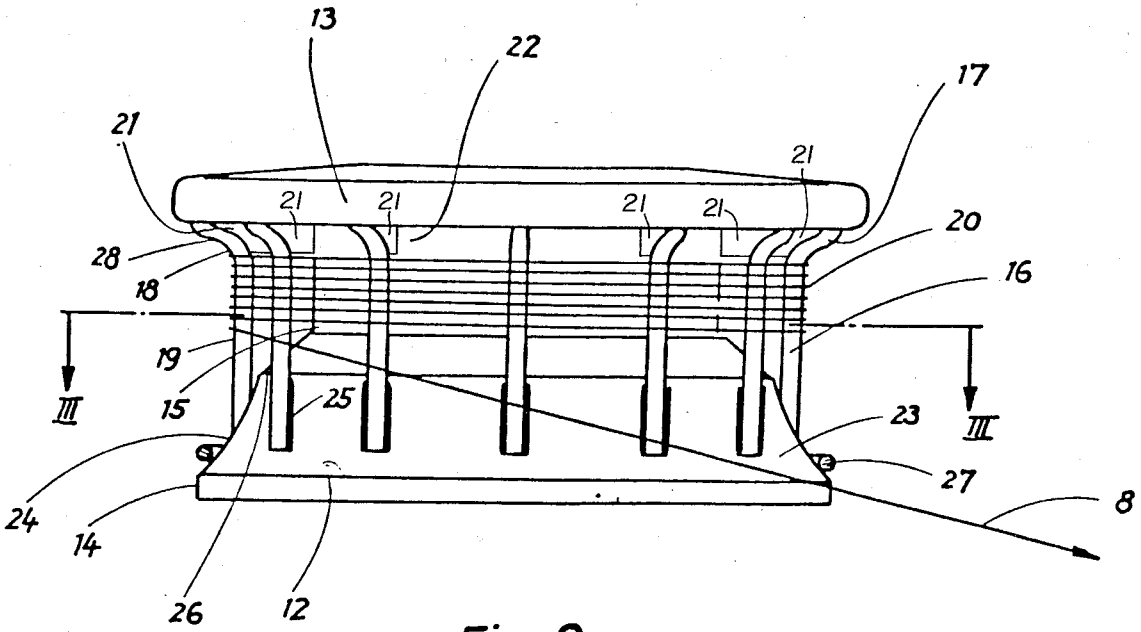
FIG. 2, a side view on a different scale of the storage drum of the yarn storage and supply apparatus of FIG. 1.

The structure of the storage drum 4 is shown in particular detail in FIGS. 2, 3:

The storage drum, essentially made of plastic material, has an approximately disk-shaped circular upper flange 13 and a similarly circular lower flange 14, forming the continuous run-off rim 12; these flanges are coaxial with one another and spaced apart from one another and are connected to one another via a coaxial hub part 15. In the manner of a cage with rods, a number of elongated yarn support elements, located at equal radial intervals from the drum shaft 2 and distributed uniformly in the circumferential direction are provided, which are formed as essentially L-shaped yokes 16 bent from hardened cylindrical steel wire having a polished surface. The yokes 16 are anchored with their ends in the two flanges 13, 14. On the yarn delivery side (at the top in FIG. 2) they each have a radially inwardly tapering region 17, which forms a run-on incline for the oncoming yarn 8, which is adjoined via a radius 18 by a substantially straight region 19, which serves as a yarn support region for a plurality of loops of a yarn winding or storage winding 20. The radius 18 between the run-on incline and the yarn support region can be on the order of magnitude of approximately one to four times the wire diameter of the yokes 16. Both the tapering regions 17 and the regions 19 associated with the radius 18 of all the yokes 16 each rest on a common imaginary rotational body that is coaxial with the drum shaft 2.

The imaginary rotational body associated with the straight region 19 is a cone having a slight inclination, the diameter of which decreases toward the run-off rim 12. The tapering in diameter for the straight regions 19 amounts to approximately 0.2 to 1 mm over their lengths.

In the vicinity of their run-on incline, at 17, the yokes 16 merge substantially at a tangent with oblique surface portions 21 of the adjoining flange 13, which are embodied as rib-like parts 22 of the flange 13 that are arranged extending substantially radially. Alternatively, an uninterrupted continuous, i.e., closed oblique surface 21 could also be provided.

Mounted on the lower flange 14 is a cover 23 of metal, or of plastic provided with a wear-resistant surface; the cover 23 can optionally also be integrally formed with the flange 14. The cover 23 in the form of a rotational body coaxial with the drum shaft 2 has a circumferential ,face 24 inclined radially inward toward the run-on inclines 17 of the yokes 16, and the yokes 16 enter with their straight regions substantially smoothly, that is, with a smooth transition, into this circumferential face 24. To this end, openings 25 that receive only the substantially straight regions 19 of the yokes are provided in the annularly continuous circumferential face 24 of the cover 23, and the edge of these openings is immediately adjacent the yoke regions 19.

The circumferential face 24 merges smoothly, in the (lower) region having the maximum diameter, with the circular run-off rim 12 and then extends radially inward with a concave curvature, extending with its region of least diameter at least as far as the middle of the substantially straight yoke regions, but in the present case to beyond the radially inner side of the substantially straight yoke regions 19.

Deviating from the embodiment shown, the circumferential face 24 could also be a conical surface. In that case, however, the width of the storage windings 20 must be dimensioned such that the outgoing yarn 8 does not leave the storage windings 20 until it is at quite a low level.

Finally, a yarn run-off ring 27 that surrounds the yokes 16 with play is attached loosely but in a captive manner to the cover 23 in such a way that the outgoing yarn 8 passes between the yarn run-off ring 27 and the circumferential face 24 of the cover 23 or run-off rim 12.

The yarn 8 arriving from the supply eyelet 6 runs up approximately at 28 in FIG. 2 onto the inwardly inclined regions 17 of the yokes 16 that form the run-on incline, and in the vicinity of the radius 18 begins to form the storage windings 20. The oncoming yarn 8 is supported at the top on the parts of the yokes 16 that are bent outward in the radius 18 and on the run-on incline and thus continuously pushes the storage windings 20 axially downward. This feeding of the storage windings 20 is facilitated by the fact that the substantially straight yarn support regions 19 of the yokes 16 rest on an imaginary cone that tapers slightly toward the run-off rim 12, as has already been explained.

The yarn 8 travelling through the storage windings 2 to the run-off eyelet 11 and from there to the knitting site sweeps from left to right, continuously from top to bottom, in the region of the storage drum 4 shown in FIG. 2, over the straight regions 19 of the yokes 16 located below the storage windings 20, and over the regions of the circumferential face 24 of the cover 23 located between and below the openings 25. As a result, there is a continuous stripping or wiping off of both the yokes 16 forming the yarn support elements and the circumferential face 24 in a substantially axial direction, as is shown once again schematically in FIG. 4. In this process an accumulation of yarn or fiber particles entrained by the yarn 8 is effectively prevented, and detached filaments are also prevented from being able to wrap around the yokes 16 in the yarn run-off region. Since the yoke regions 19 enter gently and smoothly, via the immediately adjacent openings 5, into the circumferential face 24, idle spaces that cannot be swept by the yarn 8 and that could therefore lead to an accumulation of fibers, are avoided.

The yarn run-off ring 27 attached to the cover 23 and made for instance of plastic material forces tee yarn 8 travelling through it to contact the yoke regions 19 and the circumferential face 24 of the cover 23 over the entire surface area.

In the exemplary embodiment shown, the circumferential face 24 is annularly continuous, with only the openings 25 allowing the passage of the yoke regions 19 through them; alternatively, it would also be possible to divide the oblique circumferential face 24 simply into surface regions between the yoke regions 19, in which case the yokes 16 in the vicinity of the flange 14, that is, adjoining the substantially straight regions 19, could optionally be bent obliquely outward similarly as is the case at 17, thus resulting in a substantially C-shaped form of the yokes.

As FIG. 2 shows, the yokes 16, beginning with their region 17 and until they enter into openings 25, are free-standing, because of the correspondingly small diameter of the hub region 15. Embodiments are also possible in which the yokes are embedded for example to one-half of their diameter in the plastic material comprising the drum body or the hub region 15.

The yokes 16 can also be punched from sheet steel or may be injection molded parts made from plastic material, and so forth, and it is also possible to use profiled wires that have a cross-sectional shape differing from the circular cross-sectional shape, for this purpose.

I claim:

1. Yarn storage and supply apparatus, particularly for textile machines, comprising:

a storage drum having a drum shaft, a drum body, and a plurality of elongated yarn support elements distributed circumferentially around the drum shaft at a given radial distance therefrom and extending substantially in the direction of the drum shaft;

each of said yarn support elements being in the form of a narrow yoke secured at both ends to said drum body and having, on a yarn supply side of the drum body, a first portion tapering radially inward toward the drum shaft to form a run-on incline for oncoming yarn and, adjoining this first portion, a second portion that at least in some segments is substantially straight and that forms a yarn support region for a plurality of loops of one yarn winding, wherein the first and second portions of all the yokes are, respectively, each located on common imaginary rotational bodies that are coaxial with the drum shaft;

yarn delivery means for fedding yarn to the yarn supply side of the drum body;

yarn run-off for removing yarn tangentially from a rim on a yarn run-off side of the drum body to a location positioned laterally of the drum shaft direction;

a drive means coupled to the storage drum for attaining a relative rotation between the storage drum and the yarn delivery means and yarn run-off means;

said drum body having said yarn supply side located toward one end of the drum shaft, a yarn run-off side toward the other end of the drum shaft including said rim which is a radially protruding, circular, continuous yarn run-off rim extending further axially from the yarn supply side than does the substantially straight second portion of the yokes, and means on the yarn run-off side for preventing accumulation on the yarn run-off side of fiber parts shed by the yarn, including means for defining a circumferential surface which is engaged by the yarn and extends, in the drum shaft direction, toward the yarn supply side from the run-off rim, an is radially inwardly inclined toward the drum shaft, said surface being coaxial with and coupled to the drum shaft and continuous in the circumferential direction, at least in regions located between adjacent yokes, at least part of said surface being, in the drum shaft direction, between the yarn supply side and said location to which the yarn is removed, said yokes entering the surface to form a substantially smooth transition zone therebetween;

whereby the circumferential surface on the yarn run-off side of the storage drum is axially stripped continuously by yarn running off the yarn run-off rim to clear the drum of fiber parts shed by the yarn.

2. Apparatus according to claim 1, wherein the circumferential surface begins at a region of large diameter located in the vicinity of the run-off rim, extends with a region of lesser diameter radially inward at least as far as the middle of the substantially straight yoke second portions.

3. Apparatus according to claim I, wherein at one end, the circumferential surface merges smoothly directly with the run-off rim.

4. Apparatus according to claim 1, wherein the annularly continuous circumferential surface has openings receiving the substantially straight yoke second portions.

5. Apparatus according to claim 1, wherein the circumferential surface is substantially conical.

6. Apparatus according to claim 1, wherein the circumferential surface has a concave curvature.

7. Apparatus according to claim 1, wherein the run-off side of the drum body comprises a wear-resistant material, at least in the vicinity of the circumferential surface.

8. Apparatus according to claim 1, wherein the drum body has two coaxial circular flanges to which the yokes (16) are secured on the ends and on one of which the run-off rim (12) is formed.

9. Apparatus according to claim 8, wherein the yokes are located free-standing between the flange adjacent to their first portions and the run-off side of the drum body, at least in the vicinity of the circumferential surface.

10. Apparatus according to claim 8 wherein the yokes in the vicinity of their first portion merge substantially at a tangent with oblique surface regions of the adjoining flange.

11. Apparatus according to claim 10, wherein the oblique surface regions are formed on rib-like parts, associated with the individual yokes, of the corresponding flange or of the drum body, which parts extend substantially radially.

12. Apparatus according to claim 1, wherein the drum body is made of plastic.

13. Apparatus according to claim 1 wherein the yokes rest with their substantially straight first portions on an imaginary cone, the diameter of which decreases toward the run-off rim.

14. Apparatus according to claim 13, wherein the tapering in diameter of the straight first portions of the yokes amounts to approximately 0.2 to 1 mm over their length.

15. Apparatus according to claim 1, wherein the yokes are bent from wear-resistant wire.

16. An apparatus according to claim 1, wherein a yarn run-off ring encompassing the yokes is mounted loosely but in a captive manner on the yarn run-off side of the drum body.

17. Apparatus according to claim 1, wherein the material of said yokes is sheet metal.

18. Apparatus according to claim 1, wherein the material of said yokes is plastic.

* * * * *

UNITED STATES PATENT AND TRADEMARK OFFICE

CERTIFICATE OF CORRECTION

PATENT NO. : 4,793,565

DATED : December 27, 1988

INVENTOR(S) : Josef FECKER

It is certified that error appears in the above-identified patent and that said Letters Patent is hereby corrected as shown below:

Claim 1, column 6, line 65, change "an" to -- and --

Signed and Sealed this

First Day of January, 1991

*Attest:*

HARRY F. MANBECK, JR.

*Attesting Officer*

*Commissioner of Patents and Trademarks*